US010385847B2

(12) United States Patent
Kurz et al.

(10) Patent No.: US 10,385,847 B2
(45) Date of Patent: Aug. 20, 2019

(54) RIGID PISTON-ACTUATOR-ASSEMBLY SUPPORTED FOR PERFORMING A PENDULUM-TYPE TOLERANCE COMPENSATION MOTION

(71) Applicant: Agilent Technologies, Inc., Santa Clara, CA (US)

(72) Inventors: Arne Kurz, Boblingen (DE); Bernhard Dehmer, Rastatt (DE); Lothar Mitzlaff, Nufringen (DE)

(73) Assignee: Agilent Technologies, Inc., Santa Clara, CA (US)

( * ) Notice: Subject to any disclaimer, the term of this patent is extended or adjusted under 35 U.S.C. 154(b) by 163 days.

(21) Appl. No.: 15/122,042

(22) PCT Filed: Jan. 27, 2015

(86) PCT No.: PCT/IB2015/050623
§ 371 (c)(1),
(2) Date: Aug. 26, 2016

(87) PCT Pub. No.: WO2015/128752
PCT Pub. Date: Sep. 3, 2015

(65) Prior Publication Data

US 2017/0009766 A1 Jan. 12, 2017

(30) Foreign Application Priority Data

Feb. 27, 2014 (GB) ..... 1403469.8

(51) Int. Cl.
*F04B 53/14* (2006.01)
*F04B 9/04* (2006.01)
(Continued)

(52) U.S. Cl.
CPC ..... *F04B 53/146* (2013.01); *F04B 9/02* (2013.01); *F04B 9/04* (2013.01); *F04B 9/047* (2013.01);
(Continued)

(58) Field of Classification Search
CPC .. F04B 53/14; F04B 9/04; F04B 19/22; F04B 53/22; F04B 9/02; F04B 53/146;
(Continued)

(56) References Cited

U.S. PATENT DOCUMENTS 4,754,829 A * 7/1988 Shimizu ..... B62D 5/0424 180/446
4,790,236 A * 12/1988 Macdonald ..... F04B 53/146 403/122
(Continued)

FOREIGN PATENT DOCUMENTS

CN 1398330 A 2/2003
CN 201144773 Y 11/2008
(Continued)

OTHER PUBLICATIONS

International Search Report and Written Opinion dated May 11, 2015 from related International Application No. PCT/IB2015/050623.
(Continued)

*Primary Examiner* — Charles G Freay

(57) ABSTRACT

A pump for pumping fluid, wherein the pump includes a working chamber, a piston assembly configured for reciprocating within the working chamber to thereby displace fluid, a piston actuator being rigidly assembled with the piston assembly at least in a working mode of the pump to thereby transmit drive energy to the piston assembly to reciprocate along a common rigid axis of the piston-actuator-assembly, and a bearing arrangement bearing the piston
(Continued)

assembly and the piston actuator in the pump so that the piston-actuator-assembly provided by the piston assembly and the piston actuator is capable of performing a pendulum-type compensation motion around a pendulum point at the piston actuator on the common rigid axis.

20 Claims, 5 Drawing Sheets

(51) Int. Cl.
*F04B 9/02* (2006.01)
*F04B 53/22* (2006.01)
*F04B 19/22* (2006.01)

(52) U.S. Cl.
CPC ..... *F04B 19/22* (2013.01); *F04B 53/14* (2013.01); *F04B 53/147* (2013.01); *F04B 53/22* (2013.01)

(58) Field of Classification Search
CPC ..... F04B 9/047; F04B 53/147; F16C 23/08; F16C 23/082; F16C 23/086
See application file for complete search history.

(56) References Cited

U.S. PATENT DOCUMENTS 5,253,981 A * 10/1993 Yang ..... F04B 9/047 210/101
5,312,233 A * 5/1994 Tanny ..... F04B 7/0038 417/316
5,620,524 A * 4/1997 Fan ..... B01J 4/00 118/715
5,758,930 A * 6/1998 Schiel ..... B60T 7/042 188/358
5,960,697 A 10/1999 Hayase et al.
6,357,835 B1 * 3/2002 Boisseau ..... B60T 8/00 303/113.5
9,809,245 B2 * 11/2017 Laszlo ..... B62D 5/0424
9,868,423 B2 * 1/2018 Weh ..... F04B 9/047
2003/0121414 A1 7/2003 Cautenet et al.
2005/0061722 A1 3/2005 Takao et al.
2016/0273527 A1 * 9/2016 Teshima ..... F04B 43/02

FOREIGN PATENT DOCUMENTS

CN 202811312 U 3/2013
CN 103557148 A 2/2014
DE 10 2004 061941 * 7/2006
DE 10 2011 117723 * 1/2011
GB 2481624 A 1/2012

OTHER PUBLICATIONS

U.K. Search Report dated Oct. 16, 2014 from related U.K. Application No. GB1403469.8.

* cited by examiner

RIGID PISTON-ACTUATOR-ASSEMBLY SUPPORTED FOR PERFORMING A PENDULUM-TYPE TOLERANCE COMPENSATION MOTION

RELATED APPLICATIONS

This application is the national stage of International Application No. PCT/IB2015/050623, filed Jan. 27, 2015, titled "RIGID PISTON-ACTUATOR-ASSEMBLY SUPPORTED FOR PERFORMING A PENDULUM-TYPE TOLERANCE COMPENSATION MOTION;" which claims priority to UK Patent Application No. GB 1403469.8, filed Feb. 27, 2014; the contents of both of which are incorporated herein by reference in their entireties.

BACKGROUND ART

The present invention relates to a pump for pumping fluid, to a fluid separation apparatus, and to a method of operating a pump.

In a sample separation device based on the principle of liquid chromatography, a fluidic sample to be separated is injected in a mobile phase (such as a solvent composition), wherein the mixture may be pumped through conduits and a column comprising a material (stationary phase) which is capable of separating different components of the fluidic sample. Such a material, so-called beads which may comprise silica gel, may be filled into a column tube which may be connected to other elements (like a sampling unit, a flow cell, containers including sample and/or buffers) by conduits.

For pumping a fluid constituted by the mobile phase and the fluidic sample to be separated to the sample separation device, a pump may be implemented in which a piston reciprocates within a pumping chamber to thereby displace the fluid.

U.S. Pat. No. 5,788,465 discloses a pump configured so that tools are not required to remove the pump head and disassemble the plunger. A single large hand operated knob or head nut facilitates tool-less pump head removal. The pump head is guided into position in a manifold and held in place by the hand knob. The manifold is designed to receive all the external fluidic connections made to the pump head. Fluid paths to the pump head have been replaced with miniature face seals which facilitate high pressure sealing between the pump head and manifold. Low pressure tubing seals reside in a seal wash chamber or housing and are not attached to the head, eliminating the need for tooling to disconnect them during pump head removal. A tool-less plunger mechanism includes a nutcap assembly having a plunger socket receiving a plunger assembly including a sapphire plunger fixed to a plunger holder ball accommodated by the socket. The plunger assembly is captured within the socket by a plurality of cams. The cams are spring loaded to rotate and collapse onto the plunger holder ball, pulling the plunger assembly tightly into the socket. A restricting cone is actuated to rotate the cams away from the plunger holder ball for release and removal of the plunger assembly.

However, when the pressure values according to which fluid is pumped by the pump become larger and larger, a mechanically stable pump is required which is at the same time able to deal with part and interface tolerances, in particular while mounting or maintaining the pump.

DISCLOSURE

It is an object of the invention to provide a mechanically stable pump which is able to deal with part and interface tolerances, in particular while mounting or maintaining the pump.

According to an exemplary embodiment of the present invention, a pump for pumping fluid (such as a liquid and/or a gas, optionally comprising solid particles) is provided, wherein the pump comprises a working chamber, a piston assembly configured for reciprocating within the working chamber to thereby displace fluid, a piston actuator being rigidly (in particular free of a hinge joint between piston actuator and piston assembly) assembled with the piston assembly at least in a working mode (i.e. an operation mode of the pump in which the pump is ready to displace fluid or actually displaces fluid; in one or more other operation modes of the pump, for instance a maintenance mode in which at least one component of the pump is repaired, maintained or substituted, the piston actuator and the piston assembly may or may not be rigidly assembled) of the pump to thereby transmit drive energy to the piston assembly to reciprocate along a common rigid axis of the piston-actuator-assembly (i.e. an assembly constituted by the piston assembly and the piston actuator being rigidly assembled), and a bearing arrangement bearing the piston assembly and the piston actuator in the pump so that the piston-actuator-assembly (which may act as a pendulum supported by the bearing arrangement) is capable of performing a pendulum-type compensation motion (in particular to compensate for part and/or interface tolerances, more particularly while mounting or maintaining the pump) around a pendulum point at the piston actuator on the common rigid axis.

According to another exemplary embodiment, a fluid separation apparatus for separating a fluidic sample into a plurality of fractions is provided, wherein the apparatus comprises a pump having the above-mentioned features and being configured for driving a fluid comprising a mobile phase and the fluidic sample in the mobile phase along a fluidic path, and a separation unit arranged within the fluidic path and configured for separating the fluidic sample into the plurality of fractions.

According to still another exemplary embodiment, a method of operating a pump for pumping fluid is provided, wherein the method comprises rigidly assembling a piston actuator with a piston assembly which is located at least partially within a working chamber of the pump (in particular so that the piston actuator and the piston assembly can only move and rotate together in the working mode as a single stiff body without the ability to perform any motion or rotation relative to one another), moving the piston actuator to thereby transmit drive energy to the piston assembly to reciprocate along a common rigid axis of the piston-actuator-assembly to thereby displace fluid within the working chamber, and bearing the piston assembly and the piston actuator in the pump by a bearing arrangement so that the piston-actuator-assembly (formed or constituted by the piston assembly and the piston actuator) is capable of performing a pendulum-type compensation motion (in particular for tolerance compensation) around a pendulum point at the piston actuator on the common rigid axis.

According to an exemplary embodiment, a pump is provided in which a piston assembly and a piston actuator form, at least during a fluid pumping mode or working mode, a rigid common unit or pendulum body being only movable as a whole and without any relative motion between piston assembly and piston actuator. This forms the basis for the sufficiency of a very simple bearing arrangement for bearing the common piston-actuator-assembly. According to this bearing arrangement, the pendulum may be supported so as to be able to perform equilibration or compensation motions in case of unavoidable tolerances of parts of the piston-actuator-assembly and at interfaces between such parts. The piston-actuator-assembly may hence respond to the presence of tolerances by performing a common pendulum motion around a pendulum point which is located along an extension of the piston actuator. However, apart from the enablement of performing a tolerance compensating motion, the piston-actuator-assembly may be nevertheless fixedly supported within the bearing arrangement. Such a pendulum-based drive and bearing architecture allows to significantly reduce the number of bearing positions along the piston-actuator-assembly, thereby preventing a redundant number of bearing points as it occurs in conventional approaches. By the combination of a stiff piston-actuator coupling in the working mode of the pump with a simple bearing configuration, the pump can be rendered appropriate for pumping fluid with an extremely high pressure (of for instance several hundred bars and more), while simultaneously reducing the accuracy requirements in terms of mechanical fits which support piston assembly and piston actuator. This renders the pump compact and simple in construction. In particular, the tolerance compensation motion may be of static character (in particular may occur during mounting or maintenance of the pump) rather than being dynamic during an actual fluid displacement operation of the pump.

In the following, further embodiments of the pump, the fluid separation apparatus and the method will be explained.

In an embodiment, the bearing arrangement supports the piston-actuator-assembly to enable the latter to perform a controlled pendulum-motion in the presence of pump part tolerances and/or part interface tolerances and while mounting or maintaining the pump drive. For this purpose, the piston-actuator-assembly is supported at its piston actuator by the bearing arrangement to swing around a well-defined pendulum point for tolerance compensation (in particular during a mounting procedure), wherein the pendulum point is located on the common rigid axis (FIG. 3 to FIG. 6 show four of many possibilities as to how to obtain the pendulum-type compensation motion). The mentioned pendulum-motion may be spatially limited by a volume-type bearing of the piston assembly (rather than a point-type bearing as present at the piston actuator), so that pendulum-motions for tolerance compensation can be limited to a defined spatial range.

In an embodiment, the bearing arrangement comprises an actuator bearing supporting the piston actuator at the pendulum point. In other words, the pendulum point may be defined by the position of the actuator bearing operating on the piston actuator, i.e. limiting the free mobility of the piston actuator. Advantageously, a specific point around which the piston-actuator-pendulum may perform tolerance compensation motions can be defined by the actuator bearing.

In an embodiment, the actuator bearing is configured for supporting the piston actuator at the pendulum point while allowing for a rotation, in particular with exactly two rotational degrees of freedom, of the piston-actuator-assembly around the pendulum point. A rotation of the piston-actuator-assembly along the common rigid axis may however be disabled.

In an embodiment, the actuator bearing is the only bearing which bears the piston actuator. By providing only a single bearing acting on the piston actuator, a compact and simple construction may be achieved, and the requirements in terms of mechanical fits may be kept very small. However, in an alternative embodiment, it is possible to provide one or more additional bearings for the piston actuator.

In an embodiment (see for instance FIG. 3), the actuator bearing is configured as a, in particular exactly one, spherical bearing having a plurality of bearing balls all located on a surface of a sphere around the pendulum point. In another embodiment (see for instance FIG. 4), the actuator bearing is configured as a pair of spherical bearings each having a respective plurality of bearing balls all located on a respective surface of a respective sphere, wherein the spheres both have the pendulum point as common center but have different radii. One or more spherical bearings are capable of allowing a location of the pendulum point asymmetric to or outside of the ball track positions.

In yet other embodiments (see for instance FIG. 5 or FIG. 6), the actuator bearing is configured as a groove ball bearing having a plurality of bearing balls all located in a circular ring space around the pendulum point. The implementation of one or more groove ball bearings or bearing tracks provides for a very simple and compact pump.

In an embodiment, a cross-sectional area of the circular ring space is larger than a cross-sectional area of the balls to thereby enable a tolerance compensation motion of the balls perpendicular to their motion around the circular ring space. Advantageously, the ring space may be rendered significantly larger than the balls so that the balls can move to some degree also perpendicular to their circular trajectory over a dimension which is larger than the technically required clearance. By such a configuration, it is possible with reasonable effort to increase the compensation motion of the pendulum in a scenario in which part or interface tolerances or the like occur.

In an embodiment, the bearing arrangement comprises a piston bearing supporting the piston assembly at a piston bearing location with a volume-type positioning allowance (or within a limited tolerance compensation volume), in particular within a truncated cone, to spatially limit the pendulum motion at the piston assembly. Hence, in contrast to the actuator bearing defining a pendulum point, the described embodiment uses a fixed piston bearing but still allowing for a three-dimensional volume within which the piston assembly may perform an equilibration motion to compensate for part tolerances and tolerances during mounting. Nevertheless, the piston assembly may be securely supported by the piston bearing in a spatially fixed way during the working mode of the pump, i.e. during pumping fluid. The degree or amount of volume-type positioning allowance (in particular a volume of the truncated cone) may be selected or adjusted in accordance with the sum of tolerances of all pump parts which is still accepted by a pump designer. The truncated cone volume may be such that the tolerance equilibration in the piston bearing is enabled within a tolerance compensation range of up to 10 mrad, in particular of up to 3 mrad for the pendulum range of the actuator bearing.

In an embodiment, the piston seal is the only bearing which bears the piston assembly. By providing only a single bearing acting on the piston assembly, a compact and low stress construction may be achieved, and the requirements in terms of mechanical fits may be kept very small. However, in an alternative embodiment, it is possible to provide one or more additional bearings for the piston assembly.

In an embodiment, the piston bearing comprises a fixed hollow abutment structure delimiting or defining the piston bearing location and having a through hole through which the piston assembly extends, and at least one bearing ring surrounding an exterior surface of the piston assembly and being located within the fixed hollow abutment structure. The hollow abutment structure as a theoretical position allowance may be located as a rigid part of a housing or drive cabinet of the pump.

In an embodiment, the at least one bearing ring is configured as one of the group consisting of a piston sealing, a pair of axially spaced bearing rings, and at least one bearing ring in addition to a piston sealing. In a preferred embodiment, two axially spaced bearing rings may be used, wherein an additional piston sealing may be attached to the front one of the bearing rings.

In an embodiment, an axial distance between the pendulum point and a center of the piston bearing is larger than, in particular is at least approximately three times of, more particularly is at least approximately five times of, an axial range of the piston bearing itself. If the distance between the actuator bearing and the piston bearing is significantly larger than the intrinsic extension of the piston bearing, effectively two individual bearing points are provided. This makes it possible to use mechanical fits with moderate requirements in terms of precession.

In an embodiment, the bearing arrangement comprises a plurality of bearings, wherein at least one of the piston assembly and the piston actuator is supported by only a single one of the plurality of bearings. Most preferred is an embodiment having only a single bearing for each of the piston assembly and the piston actuator. However, it is also possible to provide a larger number of bearings, for instance one actuator bearing and two piston bearings, or two actuator bearings and one piston bearing.

In an embodiment, the pump comprises a piston actuator rotation inhibitor (which may also be denoted as a wiper) configured for cooperating with the piston actuator so as to inhibit rotation of the piston actuator around a rotational axis corresponding to the common rigid axis. Hence, in addition to the piston bearing and the actuator bearing both limiting the free motion and rotation of the piston actuator and the piston assembly, respectively, it is furthermore possible to suppress an undesired rotational motion of the piston actuator along the common axis which may be triggered by a rotational motion of the drive unit such as electric motor (in particular when a ball screw is used to transfer kinetic energy from a drive unit to the piston assembly). The piston actuator rotation inhibitor may be configured to interact with the piston actuator so as to take up forces and/or moments resulting from the drive unit which may have the tendency to turn the piston actuator around the common axial direction.

In an embodiment, the piston actuator rotation inhibitor is configured for performing a rotation inhibiting interaction with the piston actuator by taking up moments from the piston actuator in a plane which includes the pendulum point and which is oriented perpendicular to the common rigid axis. Hence, the piston-actuator-pendulum may be supported by the bearing arrangement and by the piston actuator rotation inhibitor in such a way that the piston actuator rotation inhibitor impacts the piston actuator at an interaction position which is located in the mentioned pendulum point including plane. This results in a very small mechanical load exerted to the pendulum and other components of the pump due to the piston actuator rotation inhibiting.

In an embodiment, the piston actuator rotation inhibitor (or at least a part thereof) is arranged at a position in an interior of the piston actuator or at a position around (i.e. at least partially surrounding) the piston actuator. In one embodiment which results in a very compact arrangement (see for instance FIG. 3 or FIG. 4), the piston actuator may be substantially tubular, so that the piston actuator rotation inhibitor may be located within an axial through hole of the piston actuator, for instance to act circumferentially on the piston actuator for suppressing rotation around the common rigid axis. In another embodiment (see for instance FIG. 5 or FIG. 6), an interaction (such as a force transmission) between the piston actuator rotation inhibitor and the piston actuator takes place at a radially exterior position of the piston actuator. This provides a pump designer with a high degree of freedom of arranging the piston actuator.

In an embodiment, the piston actuator rotation inhibitor has a first end which is fixedly connected (for instance welded or press fit) to the piston actuator and comprises a free second end located within a (for instance spatially fixed) hollow body so as to enable a limited equilibration or compensation motion of the second end in the presence of part and/or interface tolerances. When the piston actuator tends to rotate under the influence of the drive unit, a corresponding force may be transmitted via the fixed first end towards the free second end which allows only a limited spatial equilibration motion for the first and the second degree of freedom of the pendulum rotation and a full degree of freedom along a longitudinal pump direction, i.e. along the rigid pump axis to allow an unlimited pump stroke. This maintains an efficient rotation protection of the piston actuator while allowing to compensate or balance tolerances of the components of the pump. First and second degrees of freedom of the pendulum rotation may remain enabled, and only the third degree of freedom may be limited for the piston actuator by the piston actuator rotation inhibitor.

In an embodiment, the second end is arranged to interact with the hollow body in a plane including the pendulum point and being perpendicular to the common rigid axis (see FIG. 5). Hence, the piston-actuator-pendulum may be supported by the bearing arrangement and by the piston actuator rotation inhibitor in such a way that the motion-compensating free end of the piston actuator rotation inhibitor interacts with the hollow body at an interaction position which is located in the mentioned pendulum point including plane. This results in a very small radial movement of the motion-compensating free end of the piston actuator rotation inhibitor while pendulum rotation occurs and no or only very little additional load for the piston bearing.

In an embodiment, the piston actuator is a linear actuator configured for performing a substantially linear motion (apart from small compensating motions, in particular compensating rotations along two rotation axes orthogonal to the common rigid axis) along the common rigid axis when being driven by a drive unit. The drive unit of the pump may be configured for generating the drive energy for driving the piston actuator. For example, the drive unit may be an electric motor. The drive unit may be configured for generating rotational drive energy at a drive shaft of the drive unit. In other words, when the drive unit is active for generating kinetic energy, it rotates the drive shaft which, in turn, transmits its rotation energy via a gear mechanism to the piston actuator which consequently moves linearly.

In other words, the gear mechanism may be configured for converting the rotational drive energy into a linear motion of the piston actuator. There are different configurations for such a gear mechanism.

In a preferred embodiment, the gear mechanism in cooperation with the piston actuator are configured as a ball screw. Such a ball screw comprises a mandrel (such as a tubular member with an exterior working surface) as the piston actuator and a nut (such as another tubular member with an interior working surface mounted radially around and cooperating with the mandrel at their working surfaces) cooperating with the mandrel and being rotatable by the drive unit. The mandrel may be a tubular element having an exterior thread, and the nut may have an internal thread and may be mounted on the mandrel so that the nut may rotate under the influence of the drive unit and may therefore force the mandrel to move linearly. It is also possible that at least two ball tracks are provided between the mandrel and the nut, which balls are running in grooves formed and delimited between the nut and the mandrel. The latter configuration has the advantage of an advantageously low friction.

The gear mechanism in cooperation with the piston actuator may be alternatively configured as a ball screw comprising a nut as the piston actuator and a mandrel cooperating with the nut and being rotatable by the drive unit. In such a configuration, the function of the nut and the mandrel may be exchanged as compared to the previously described embodiment. The piston assembly may then be directly coupled with the linearly moving nut, and the mandrel may be coupled to the drive unit to rotate.

Further alternatively, the gear mechanism in cooperation with the piston actuator may be configured as a completely different mechanism such as a rack and pinion gear, or as a hydraulic mechanism.

Coming back to the previously described embodiment of a ball screw with a mandrel being configured as the piston actuator, the pump may comprise a mandrel rotation inhibitor member (as a specific example for a piston actuator rotation inhibitor member) configured for cooperating with the mandrel so as to inhibit rotation of the mandrel when the nut rotates.

In an embodiment, the pump furthermore comprises a shaft tooth wheel mounted for rotating with the drive shaft (in particular the teeth of the shaft tooth wheel may be arranged around the rotatable shaft) and a nut tooth wheel (in particular the teeth of the nut tooth wheel may be arranged around the rotatable nut) mounted for rotating with the nut, wherein the shaft tooth wheel and the nut tooth wheel are arranged to engage one another (via their respective teeth) so as to transfer drive energy from the drive shaft via the nut to the mandrel. The transfer of drive energy via a shaft tooth wheel cooperating with a nut tooth wheel is highly advantageous, since any undesired mechanical impact such as a tilting, a vibration, a knock, etc. acting on the pump can be efficiently absorbed by the engaging tooth wheels. An advantageous slight weakening of the mutual teeth-teeth coupling (for instance by arranging the tooth wheels with mutual clearance so as to allow for a slight compensation motion or rotation of one tooth wheel without impacting the other tooth wheel) allows to cope with part and interface tolerances of the pump and to spatially keep distortions within a respective part of the pump without transferring them to other parts.

In an embodiment, the shaft tooth wheel and the nut tooth wheel are a pair of straight toothed spur wheels. In an alternative embodiment, the shaft tooth wheel and the nut tooth wheel are a pair of helical toothed spur wheels.

In an embodiment, the shaft tooth wheel and the nut tooth wheel are located so as to engage one another in a plane including the pendulum point and being perpendicular to the common rigid axis (see for instance FIG. 3 to FIG. 5). Hence, the piston-actuator-pendulum may be supported by the bearing arrangement in such a way that the drive energy transfer between the tooth wheels occurs at an interaction position which is located in the mentioned pendulum point including plane. This results in a very small driving load exerted to the piston bearing of the pump since the driving forces acts without or only with very small leverage distance to the pendulum point and thus no or only very small additional moments perpendicular to the piston bearing occurs.

In another embodiment, the shaft tooth wheel and the nut tooth wheel are located so as to engage one another outside of a plane including the pendulum point and being perpendicular to the common rigid axis, and the second end of the piston actuator rotation inhibitor is arranged to interact with the hollow body at an opposite side of this plane, and wherein a contact area of the shaft tooth wheel and the nut tooth wheel on the one hand and a contact area of the second end on the other hand are located relatively to one another so that residual moments acting on the piston actuator are less than approximately 20% of the moments generated by the drive unit, in particular are close to zero. By adjusting an appropriate spatial relationship between the position of the tooth wheels, the force absorption area of the piston actuator rotation inhibitor and the common rigid axis comprising the pendulum point, it is possible to keep the piston bearing of the pump free or within a negligible amount of undesired mechanical loads. This can be achieved from an arrangement of the components in such a way that a moment generated by the drive unit force multiplied by the axial distance between the tooth wheels engagement and the plane including the pendulum point are compensated by the axial and radial position of the engagement of the opposite arranged piston actuator rotation inhibitor.

In an embodiment, the shaft tooth wheel and the nut tooth wheel are configured to provide a gear reduction from the drive unit to the nut, in particular a gear reduction in a range between approximately 1:2 and approximately 1:10, more particularly a gear reduction in a range between approximately 1:3 and approximately 1:7. With such a gear reduction, the requirements in terms of torque provided by the drive unit and the resolution of an incremental encoder operating on the drive unit are significantly reduced. In other words, the provision of the mentioned gear reduction allows to implement simple and small drive units as well as a simple encoder.

In an embodiment, the piston assembly comprises a piston and a piston base at which the piston is mounted, wherein the piston forms a free front section of the piston assembly displacing the fluid and the piston base forms a rear section of the piston assembly rigidly assembled with the piston actuator in the working mode of the pump. The piston may be a cylindrical member having a front face displacing the fluid and having a lateral surface sliding along the working chamber sealed by a sealing. The piston base or piston foot comprises a recess or accommodation volume for accommodating an end of the piston and comprises another section cooperating with the piston actuator.

In an embodiment, the pump comprises a pump head comprising the working chamber and the piston assembly and comprises a pump base accommodating the piston actuator, wherein the pump head and the pump base are configured to be fastenable to one another or unfastenable from one another by actuating a fastener. For example, such a fastener may be embodied by one or more screws to be operated by a screwdriver to thereby connect the pump head to the pump base. In an embodiment, the drive unit is located within the pump base.

In an embodiment, the pump is configured as one of the group consisting of a micropump (in particular having a flow rate of microliters per minute), a nanopump (in particular having a flow rate of nanoliters per minute), a liquid chromatography pump (for instance a high pressure pump for pumping mobile phase in an HPLC), and a preparative pump (i.e. a pump for preparative purposes). Thus, the described motion compensation and bearing architecture is compatible with very different kinds of pumps.

In an embodiment, the pump is configured for pumping the fluid with a pressure of at least 500 bar, in particular of at least 1000 bar, more particularly of at least 1500 bar. In the presence of such high pressure values, the relaxed requirements concerning mechanical fits due to the simple bearing arrangement and the pendulum like piston-actuator-assembly are particularly pronounced.

The separation unit may be filled with a separating material. Such a separating material which may also be denoted as a stationary phase may be any material which allows an adjustable degree of interaction with a sample fluid so as to be capable of separating different components of such a sample fluid. The separating material may be a liquid chromatography column filling material or packing material comprising at least one of the group consisting of polystyrene, zeolite, polyvinylalcohol, polytetrafluorethylene, glass, polymeric powder, silicon dioxide, and silica gel, or any of above with chemically modified (coated, capped etc) surface. However, any packing material can be used which has material properties allowing an analyte passing through this material to be separated into different components, for instance due to different kinds of interactions or affinities between the packing material and fractions of the analyte.

At least a part of the separation unit may be filled with a fluid separating material, wherein the fluid separating material may comprise beads having a size in the range of essentially 1 μm to essentially 50 μm. Thus, these beads may be small particles which may be filled inside the separation section of the microfluidic device. The beads may have pores having a size in the range of essentially 0.01 μm to essentially 0.2 μm. The fluidic sample may be passed through the pores, wherein an interaction may occur between the fluidic sample and the pores.

The separation unit may be a chromatographic column for separating components of the fluidic sample. Therefore, exemplary embodiments may be particularly implemented in the context of a liquid chromatography apparatus.

The fluid separation apparatus may be configured to conduct a liquid mobile phase through the separation unit. As an alternative to a liquid mobile phase, a gaseous mobile phase or a mobile phase including solid particles may be processed using the fluid separation apparatus. Also materials being mixtures of different phases (solid, liquid, gaseous) may be processed using exemplary embodiments. The fluid separation apparatus may be configured to conduct the mobile phase through the system with a high pressure, particularly of at least 600 bar, more particularly of at least 1200 bar.

The fluid separation apparatus may be configured as a microfluidic device. The term "microfluidic device" may particularly denote a fluid separation apparatus as described herein which allows to convey fluid through microchannels having a dimension in the order of magnitude of less than 500 μm, particularly less than 200 μm, more particularly less than 100 μm or less than 50 μm or less.

Exemplary embodiments may be implemented in a sample injector of a liquid chromatography apparatus which sample injector may take up a sample fluid from a fluid container and may inject such a sample fluid in a conduit for supply to a separation column. During this procedure, the sample fluid may be compressed from, for instance, normal pressure to a higher pressure of, for instance several hundred bars or even 1000 bar and more. An autosampler may automatically inject a sample fluid from the vial into a sample loop (alternatively, a fixed loop concept may be applied). A tip or needle of the autosampler may dip into a fluid container, may suck fluid into the capillary and may then drive back into a seat to then, for instance via a switchable fluidic valve, inject the sample fluid towards a sample separation section of the liquid chromatography apparatus.

The fluid separation apparatus may be configured to analyze at least one physical, chemical and/or biological parameter of at least one component of the sample fluid in the mobile phase. The term "physical parameter" may particularly denote a size or a temperature of the fluid. The term "chemical parameter" may particularly denote a concentration of a fraction of the analyte, an affinity parameter, or the like. The term "biological parameter" may particularly denote a concentration of a protein, a gene or the like in a biochemical solution, a biological activity of a component, etc.

The fluid separation apparatus may be implemented in different technical environments, like a sensor device, a test device, a device for chemical, biological and/or pharmaceutical analysis, a capillary electrophoresis device, a liquid chromatography device, a gas chromatography device, an electronic measurement device, or a mass spectroscopy device. Particularly, the fluid separation apparatus may be a High Performance Liquid Chromatography (HPLC) device by which different fractions of an analyte may be separated, examined and analyzed.

An embodiment of the present invention comprises a fluid separation apparatus configured for separating compounds of a sample fluid in a mobile phase. The fluid separation apparatus may comprise a mobile phase drive, such as a pumping system, configured to drive the mobile phase through the fluid separation apparatus. A separation unit, which can be a chromatographic column, is provided for separating compounds of the sample fluid in the mobile phase. The fluid separation apparatus may further comprise a sample injector configured to introduce the sample fluid into the mobile phase, a detector configured to detect separated compounds of the sample fluid, a collector configured to collect separated compounds of the sample fluid, a data processing unit configured to process data received from the fluid separation apparatus, and/or a degassing apparatus for degassing the mobile phase.

Embodiments of the present invention might be embodied based on most conventionally available HPLC systems, such as the Agilent 1290 Series Infinity system, Agilent 1200 Series Rapid Resolution LC system, or the Agilent 1100 HPLC series (all provided by the applicant Agilent Technologies—see www.agilent.com—which shall be incorporated herein by reference).

One embodiment comprises a pump having a piston for reciprocation in a pump working chamber to compress liquid in the pump working chamber to a high pressure at which compressibility of the liquid becomes noticeable. One embodiment comprises two pumps coupled either in a serial or parallel manner.

The mobile phase (or eluent) can be either a pure solvent or a mixture of different solvents. It can be chosen e.g. to minimize the retention of the compounds of interest and/or the amount of mobile phase to run the chromatography. The mobile phase can also be chosen so that the different compounds can be separated effectively. The mobile phase might comprise an organic solvent like e.g. methanol or acetonitrile, often diluted with water. For gradient operation water and organic are delivered in separate bottles, from which the gradient pump delivers a programmed blend to the system. Other commonly used solvents may be isopropanol, tetrahydrofuran (THF), hexane, ethanol and/or any combination thereof or any combination of these with aforementioned solvents.

The sample fluid might comprise any type of process liquid, natural sample like juice, body fluids like plasma or it may be the result of a reaction like from a fermentation broth.

The fluid is preferably a liquid but may also be or comprise a gas and/or a supercritical fluid (as e.g. used in supercritical fluid chromatography—SFC—as disclosed e.g. in U.S. Pat. No. 4,982,597 A).

The pressure in the mobile phase might range from 2-200 MPa (20 to 2000 bar), in particular 10-150 MPa (100 to 1500 bar), and more particularly 50-120 MPa (500 to 1200 bar).

BRIEF DESCRIPTION OF DRAWINGS

Other objects and many of the attendant advantages of embodiments of the present invention will be readily appreciated and become better understood by reference to the following more detailed description of embodiments in connection with the accompanying drawings. Features that are substantially or functionally equal or similar will be referred to by the same reference signs.

Figure 1:
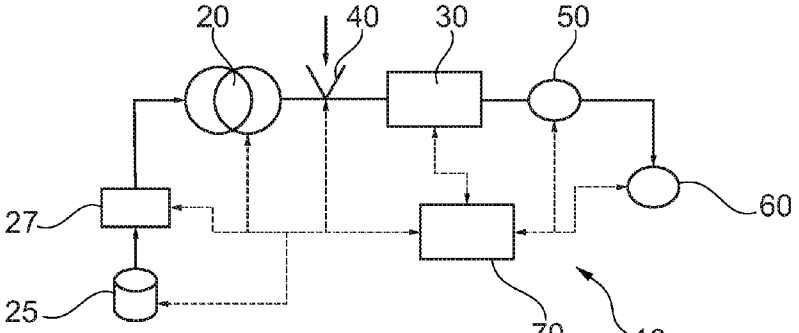
FIG. 1 shows a liquid separation device in accordance with embodiments of the present invention, particularly used in high performance liquid chromatography (HPLC).

The illustration in the drawing is schematic.

Before, referring to the drawings, exemplary embodiments will be described in further detail, some basic considerations will be summarized based on which exemplary embodiments of the invention have been developed.

An exemplary embodiment of the invention provides a pendulum drive for a piston and valve based High Pressure Solvent Delivery System (SDS) for a High Performance Liquid Chromatography (HPLC) apparatus.

Conventional high pressure fluid pumps divide the functionality of force generation and piston movement on the one hand and the functionality of solvent delivery on the other hand in two separate mechanical assemblies. Such an approach generates a critical interface between these assemblies which needs to offer all necessary degrees of freedom, in terms of a consequently very complex bearing arrangement, to prevent redundant guidance or forces. Within the past view years, the pressure requirements for SDS increased dramatically (400 bar, 600 bar, 1200 bar), and to fulfill the above described approach additional expensive parts and tight tolerance work are required in terms of the design of a bearing arrangement.

Exemplary embodiments of the invention allow for an increase in reliability of a pump at lower manufacturing costs. Such an approach provides a generic concept as a building set for a broad application range. Furthermore, a broad tolerance acceptance for critical interfacing parts is immanent. This leads to cost savings within the mechanical arrangement according to exemplary embodiments. In such an embodiment, the electrical driving moment can be indirectly coupled by a pair of toothed spur wheels (in particular a drive tooth wheel and a nut tooth wheel) which allows gear reduction and two additional degrees of freedom in rotation if arranged according to embodiments of the invention. The gear reduction leads to a further simplification of the drive unit such as an electric motor (which may be configured with more speed while allowing to downsize the requirements in terms of torque demand) and of an incremental encoder (which may operate with higher resolution by gear reduction while at the same time allowing for a lower resolution demand for the encoder).

A common rigid axis or axle for the functionality of force generation and piston movement on the one hand and the functionality of solvent delivery on the other hand is a feature according to an exemplary embodiment of the invention which provides significant advantages. Another advantageous feature implementable in a pump according to an exemplary embodiment of the invention is the reduction, as compared to conventional approaches, of the complexity and hence space requirements of a bearing arrangement to two axle bearing points or sections. A first axle bearing point (which can also be denoted as actuator bearing) of the force generation and piston movement limits two translational degrees of freedom but keeps the full freedom in rotation (like a ball joint or three-dimensional pendulum bearing). A second axle bearing point or section (which may also be denoted as piston bearing) can be located close to a piston sealing of the solvent delivery part and may be configured to limit two of rotatory degrees of freedom. The third translational degree of freedom may be controlled by an axial ball screw movement of either a mandrel or a nut of a ball screw assembly and may deliver the motion for the pump function. The third rotatory degree of freedom may be limited close to a swivel area of the first axle bearing point of the force generation and piston movement. This is one part of a further feature of a pump according to an exemplary embodiment of the invention since this arrangement keeps the second axle bearing point almost free of additional load while compensating for driving torque. Another part of the mentioned feature is the way how the driving torque is coupled into the ball screw assembly. If the ball screw nut is driven, a toothed spur wheel can be fixed to the ball screw nut aligned with the first axle bearing point of the force generation and piston movement. While a pinion of the motor can be fixed to a drive cabinet or casing of the pump, the spur wheel of the ball screw may move along the allowance of the freedom in rotation. It should be clear that two of these directions of freedom in rotation may be limited (in particular may be minimized) to compensate for part and interface tolerances and while mounting or maintaining the pump drive. According to such an embodiment, it is possible to keep all driving forces and moments very close to the neutral area of the first axle bearing point of the force generation and piston movement resulting in marginal additional load for the fixed bearing or the second axle bearing point located close to the piston sealing of the solvent delivery part.

Referring now in greater detail to the drawings, FIG. 1 depicts a general schematic of a liquid separation system 10. A pump 20 receives a mobile phase from a solvent supply 25, typically via a degasser 27, which degases and thus reduces the amount of dissolved gases in the mobile phase. The pump 20—as a mobile phase drive—drives the mobile phase through a separating unit 30 (such as a chromatographic column) comprising a stationary phase. A sampling unit 40 can be provided between the pump 20 and the separating unit 30 in order to subject or add (often referred to as sample introduction) a sample fluid into the mobile phase. The stationary phase of the separating unit 30 is configured for separating compounds of the sample liquid. A detector 50 is provided for detecting separated compounds of the sample fluid. A fractionating unit 60 can be provided for outputting separated compounds of sample fluid.

While the mobile phase can be comprised of one solvent only, it may also be mixed from plural solvents. Such mixing might be a low pressure mixing and provided upstream of the pump 20, so that the pump 20 already receives and pumps the mixed solvents as the mobile phase. Alternatively, the pump 20 might be comprised of plural individual pumping units, with plural of the pumping units each receiving and pumping a different solvent or mixture, so that the mixing of the mobile phase (as received by the separating unit 30) occurs at high pressure and downstream of the pump 20 (or as part thereof). The composition (mixture) of the mobile phase may be kept constant over time, the so called isocratic mode, or varied over time, the so called gradient mode.

A data processing unit 70, which can be a conventional PC or workstation, might be coupled (as indicated by the dotted arrows) to one or more of the devices in the liquid separation system 10 in order to receive information and/or control operation. For example, the data processing unit 70 might control operation of the pump 20 (e.g. setting control parameters) and receive therefrom information regarding the actual working conditions (such as output pressure, flow rate, etc. at an outlet of the pump 20). The data processing unit 70 might also control operation of the solvent supply 25 (e.g. setting the solvent/s or solvent mixture to be supplied) and/or the degasser 27 (e.g. setting control parameters such as vacuum level) and might receive therefrom information regarding the actual working conditions (such as solvent composition supplied over time, flow rate, vacuum level, etc.). The data processing unit 70 might further control operation of the sampling unit 40 (e.g. controlling sample injection or synchronization of sample injection with operating conditions of the pump 20). The separating unit 30 might also be controlled by the data processing unit 70 (e.g. selecting a specific flow path or column, setting operation temperature, etc.), and send—in return—information (e.g. operating conditions) to the data processing unit 70. Accordingly, the detector 50 might be controlled by the data processing unit 70 (e.g. with respect to spectral or wavelength settings, setting time constants, start/stop data acquisition), and send information (e.g. about the detected sample compounds) to the data processing unit 70. The data processing unit 70 might also control operation of the fractionating unit 60 (e.g. in conjunction with data received from the detector 50) and provide data back.

Figure 2:
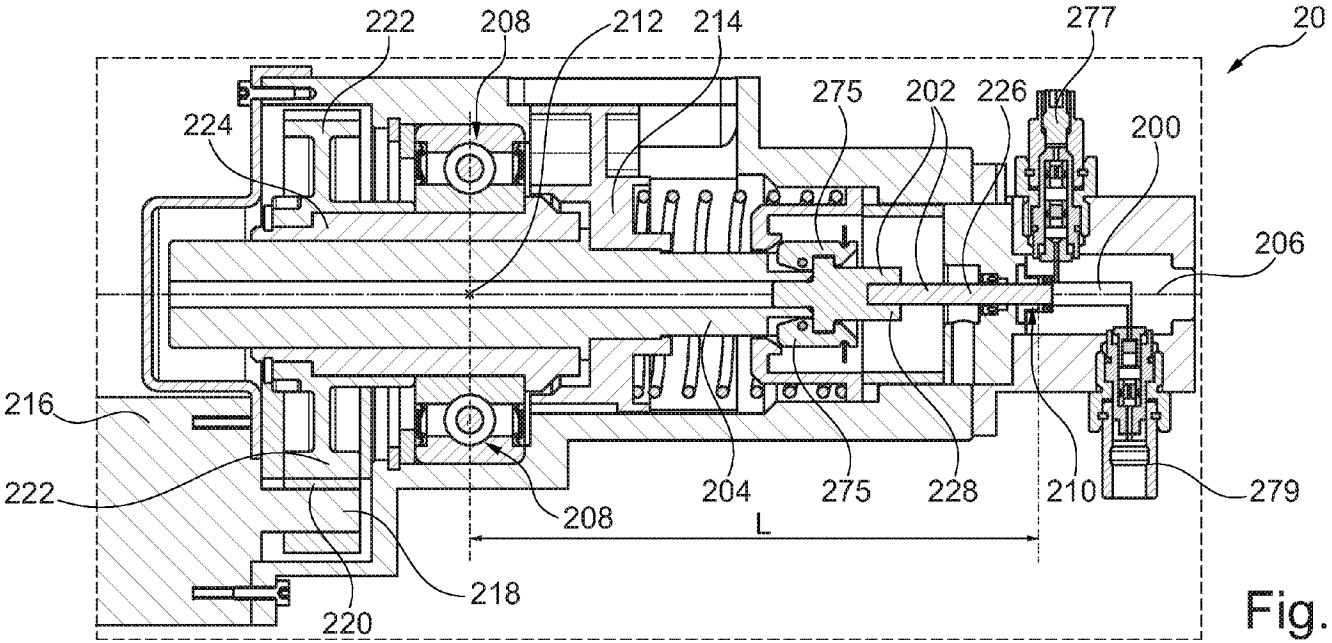
FIG. 2 illustrates a cross-sectional view of a pump according to an exemplary embodiment of the invention in a working mode.

FIG. 2 illustrates a cross-sectional view of a pump 20 according to an exemplary embodiment of the invention in a working mode (i.e. when the pump 20 is assembled and therefore ready to displace fluid such as a liquid).

The pump 20 comprises a working chamber 200 and a piston assembly 202 configured for reciprocating within the working chamber 200 to thereby displace fluid. By a reciprocation of the piston assembly 202 along a horizontal direction of FIG. 2, the fluid may be displaced between an inlet valve 277 and an outlet valve 279 (their function may also be interexchanged). The piston assembly 202 is constituted by a cylindrical piston 226 rigidly mounted on a piston base 228 (which may also be denoted as piston foot). A linear piston actuator 204 is also foreseen and rigidly assembled with the piston assembly 202 in the illustrated working mode of the pump 20, so that the piston actuator 204 and the piston assembly 202 are fully disabled to perform any motion or rotation independently from one another. In other words, when rigidly coupled to one another as shown in FIG. 2, the piston actuator 204 and the piston assembly 202 perform any translational and/or rotational motion always and only together as a whole. In the embodiment of FIG. 2, a pair of engagement levers 275 mounted on the piston actuator 204 engage with the piston assembly 202 and therefore ensure the rigid coupling between piston assembly 202 and piston actuator 204 in the shown working mode of the pump 20. For maintenance purposes, i.e. in a maintenance mode (not shown), it is however possible to temporarily disassemble the piston assembly 202 from the piston actuator 204, for instance for maintenance, repair or substitution of a (for instance damaged or worn out) piston assembly 202. A corresponding separation between piston assembly 202 and piston actuator 204 may be achieved by forcing the engagement levers 275 to rotate (for instance triggered by disassembling a pump head on the right-hand side of FIG. 2 from a pump base on the left-hand side of FIG. 2) so that the engagement levers 275 disengage the piston assembly 202. Such a maintenance mode is however different from the above-described working mode of the pump 20 in which the piston assembly 202 and the piston actuator 204 remain rigidly coupled.

A drive unit 216, such as an electric motor, generates rotational energy used for driving the piston actuator 204 and, in turn, the piston assembly 202, for pumping the fluid. The drive unit 216 rotates a drive shaft 218 for providing kinetic energy which is to be transferred to the piston assembly 202. For the purpose of this energy transfer, the pump 20 comprises a gear mechanism which is configured for converting the rotational drive energy of the drive shaft 218 into a linear motion of the piston actuator 204 along a horizontal axis of FIG. 2. Via a shaft tooth wheel 220 constituted by a plurality of teeth circumferentially surrounding the drive shaft 218, the rotational energy is transferred to a nut tooth wheel 222 which is rigidly coupled to and arranged around a nut 224 of a ball screw assembly, thereby rotating the nut 224. The teeth of the shaft tooth wheel 218 and the teeth of the nut tooth wheel 220 mesh or engage one another with some degree of clearance so as to enable the shaft tooth wheel 218 and the nut tooth wheel 222 to perform some independent compensation motion, for instance in the event of part and/or interface tolerances and while mounting or maintaining parts of the pump 20. The shaft tooth wheel 218 and the nut tooth wheel 220 are dimensioned to provide a gear reduction of about 1:5 from the drive unit 216 to the nut 224, which reduces the demand concerning required torque to be provided by the drive unit 216. This allows not only to implement a very simple drive unit 216, but also to implement a very simple incremental encoder located at the drive shaft 218 of the drive unit 216 (not shown). Via a pair of threads (not shown in FIG. 2), the rotating nut 224 cooperates with a tubular mandrel constituting the piston actuator 204. The nut 224 and the mandrel-type piston actuator 204 thereby constitute a ball screw assembly.

A piston actuator rotation inhibitor 214 impacts the piston actuator 204 in such a manner that the piston actuator 204 can only be moved in a translatory manner along a common rigid axis 206 of the rigidly coupled piston-actuator-assembly without rotating around the common rigid axis 206.

Thereby, it is possible to transmit exclusively longitudinal drive energy to the piston assembly 202 to reciprocate along the common rigid axis 206 of the piston-actuator-assembly.

The pump 20 furthermore comprises a bearing arrangement 208, 210 for bearing the piston assembly 202 and the piston actuator 204 within the pump 20. The bearing arrangement 208, 210 reduces the free movability of the rigid pendulum like piston-actuator-assembly in the interior of the pump 20 in a defined manner. More specifically, the bearing arrangement 208, 210 supports the piston actuator 204 and the piston assembly 202 so that the piston-actuator-assembly is capable of performing a collective tolerance compensating pendulum motion around a pendulum point 212 located in the piston actuator 204 on the common rigid axis 206. The bearing arrangement 208, 210 is hereby formed by two bearings only, i.e. an actuator bearing 208 and a piston bearing 210.

The actuator bearing 208 (here configured as a groove ball bearing, compare FIG. 5 and FIG. 6 for details) is the only bearing assigned to the piston actuator 204 and supports the piston actuator 204 at the pendulum point 212 while allowing for a rotation with exactly three rotational degrees of freedom of the piston-actuator-assembly around the pendulum point 212. Rotation axes corresponding to two rotational degrees of freedom are both oriented perpendicular to the common rigid axis 206 and limited by the piston bearing 210. The piston actuator rotation inhibitor 214 is here configured to limit the third rotational degree of freedom performing a rotation inhibiting interaction with the piston actuator 204 by taking up moments from the piston actuator 204 which prevents rotation around the common rigid axis 206.

Figure 3:
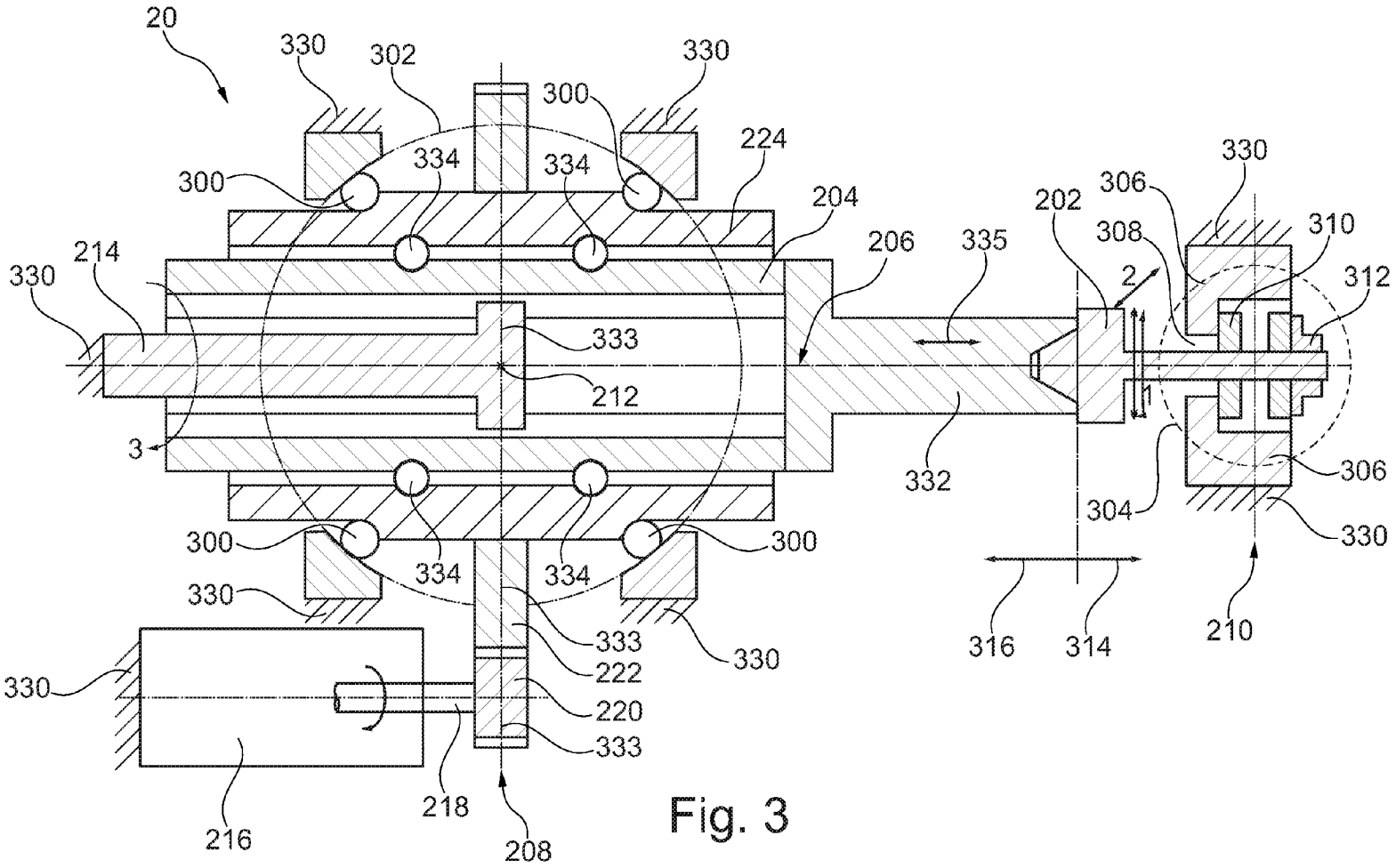
FIG. 3 illustrates a schematic view of a pump according to another exemplary embodiment of the invention.

The piston bearing 210 is the only bearing which bears the piston assembly 202. Advantageously, an axial distance L (for instance in a range between 30 mm and 200 mm, for example approximately 100 mm), between the actuator bearing 208 and the piston bearing 210 is significantly larger than an intrinsic volume of the actuator bearing 208 and an intrinsic volume of the piston bearing 210. Therefore, the actuator bearing 208 and the piston bearing 210 may effectively behave as point-like bearings (although in particular the piston bearing 210 may have some not neglectable intrinsic axial extension, as shown in FIG. 3 in more detail. The actuator bearing 208 is configured as a groove ball bearing with preferred intentionally increased clearance (between groove delimiting walls and balls running along the groove), to thereby enable the actuator bearing 208 to tolerate equilibration or compensation motions within a certain defined range (of for instance ±3 mrad).

As a result of its simplicity and the low number of bearing positions along the extension of the piston-actuator-assembly in the direction of the common rigid axis 206, the bearing arrangement 208, 210 does not involve any undesired overdetermination into the bearing architecture and is therefore compatible with relaxed demands in terms of the accuracy of mechanical fits used for bearing and supporting the piston-actuator-assembly.

FIG. 3 illustrates a schematic view of a pump 20 according to another exemplary embodiment of the invention.

FIG. 3 shows that the pump 20 comprises a pump head 314 (for solvent delivery, i.e. the hydraulic part of the pump 20) which comprising the working chamber 200 and the piston assembly 202. Furthermore, the pump 20 comprises a pump base 316 (for force generation and piston movement) accommodating the piston actuator 204. The drive unit 216 is located within the pump base 316 as well. The pump head 314 and the pump base 316 are configured to be fastenable to one another or unfastenable from one another by actuating a fastener (not shown).

Some details illustrated in FIG. 3 shall be described in the following: Reference numeral 330 in FIG. 3 indicates individual sections or portions of a drive cabinet or housing of the pump 20 via which the corresponding members of the pump 20 are rigidly supported. A rigid coupler rigidly coupling the piston assembly 202 with the piston actuator 204 is denoted with reference numeral 332. It is however also possible to directly rigidly couple the piston assembly 202 with the piston actuator 204. Friction reduction balls 334 may run along grooves between the piston actuator 204 and the nut 224.

As in FIG. 2, also the pump 20 shown in FIG. 3 comprises the shaft tooth wheel 220 mounted for rotating with the drive shaft 218 and the nut tooth wheel 222 mounted for rotating with the nut 224. The shaft tooth wheel 220 and the nut tooth wheel 222 are arranged so that their respective teeth engage one another so as to transfer drive energy from the drive shaft 218 via the shaft tooth wheel 220, the nut tooth wheel 222, and the nut 224 to the mandrel constituting the piston actuator 204. As can be taken from FIG. 3, the shaft tooth wheel 220 and the nut tooth wheel 222 are located so that their teeth engage one another in a plane 333 including the pendulum point 212 and being perpendicular to the common rigid axis 206, i.e. at or very close to a neutral axis. In the scenario of a tilting of the piston-actuator-assembly, the teeth of the tooth wheels 222 follow this tilting motion along a neutral axial distance using the engaging clearance between the shaft tooth wheel 220 and the nut tooth wheel 222. Hence, an undesired transmission of lateral forces between the tooth wheels 220, 222 and an undesired axial displacement is efficiently suppressed. In other words, with the shown gear mechanism, an effective direction of force is guided close to the swivel area of the ball screw.

In the embodiment of FIG. 3, the piston actuator rotation inhibitor 214 is arranged in an interior through hole of the tubular piston actuator 204 which results in a compact construction. As can be taken from FIG. 3, also the piston actuator rotation inhibitor 214 operates (i.e. contacts an interior surface of the piston actuator 204 for force transmission) at or very close to the plane 333 and symmetrical to the common rigid axis 206 (pendulum point 212 or center of sphere 302).

The bearing arrangement 208, 210 in the embodiment of FIG. 3 comprises the actuator bearing 208 (which may also be denoted as first axle bearing point or bearing section) in the configuration of a spherical bearing (or ball nut bearing) having a plurality of bearing balls 300 all located on a surface of a (virtual) sphere 302 around the pendulum point 212. This symmetric arrangement has a very high tolerance with regard to external distortions and therefore allows for proper balancing or equilibration motions of the system.

The bearing arrangement 208, 210 in the embodiment of FIG. 3 comprises the piston bearing 210 (which may also be denoted as second axle bearing point or bearing section). Before continuing to explain FIG. 3 in further detail, a general remark concerning the embodiments of FIG. 3 to FIG. 6 should be made. In all of the schematic illustrations of FIG. 3 to FIG. 6, the piston bearing 210 is shown with a piston bearing location 304 which appears in the drawing to have a certain interior volume. However, it should be clarified that this interior volume only schematically illustrates a virtual volume (i.e. for a volume-type positioning allowance) within which the bearing arrangement 208, 210 is capable of compensating parts and/or interface tolerances.

In this active working mode, the piston-actuator-assembly is fixedly supported within the bearing arrangement 208, 210.

The piston bearing 210 is configured for supporting the piston assembly 202 at piston bearing location 304 to spatially limit the tolerance compensating pendulum motion of the pendulum-type piston-actuator assembly at the position of the piston assembly 202. More specifically, the piston bearing 210 comprises a fixed hollow abutment structure 306 defining the volume-type positioning allowance and the piston bearing location 304 and having a through hole 308 through which the piston assembly 202 extends in an axial direction. Two axially spaced bearing rings 310 of the piston bearing 210 surround an exterior surface of the piston assembly 202 circumferentially and are supported by the fixed hollow abutment structure 306 fixedly mounted at the drive cabinet 330. In addition, a piston sealing 312 is located at a front flange face of one of the bearing rings 210 and seals the piston assembly 202.

As can be taken from FIG. 3, an axial distance between the pendulum point 212 and a center of the piston bearing 210 is many times larger than an axial range of the piston bearing location 304 or an axial range of the intrinsic extension of the piston bearing 210. Thus, although the piston bearing 210 has some internal composition, it acts efficiently as one single bearing.

In the embodiment of FIG. 3, all driving forces and moments act very close to the neutral area (see plane 333) resulting in only marginal additional load for the fixed bearing. Two allowed rotational degrees of freedom are labeled "1" and "2" in FIG. 3, whereas a third rotational degree of freedom limited or disabled by the piston actuator rotation inhibitor 214 is labeled "3" in FIG. 3. An axial motion corresponding to a reciprocation is indicated by reference numeral 335 in FIG. 3.

Figure 4:
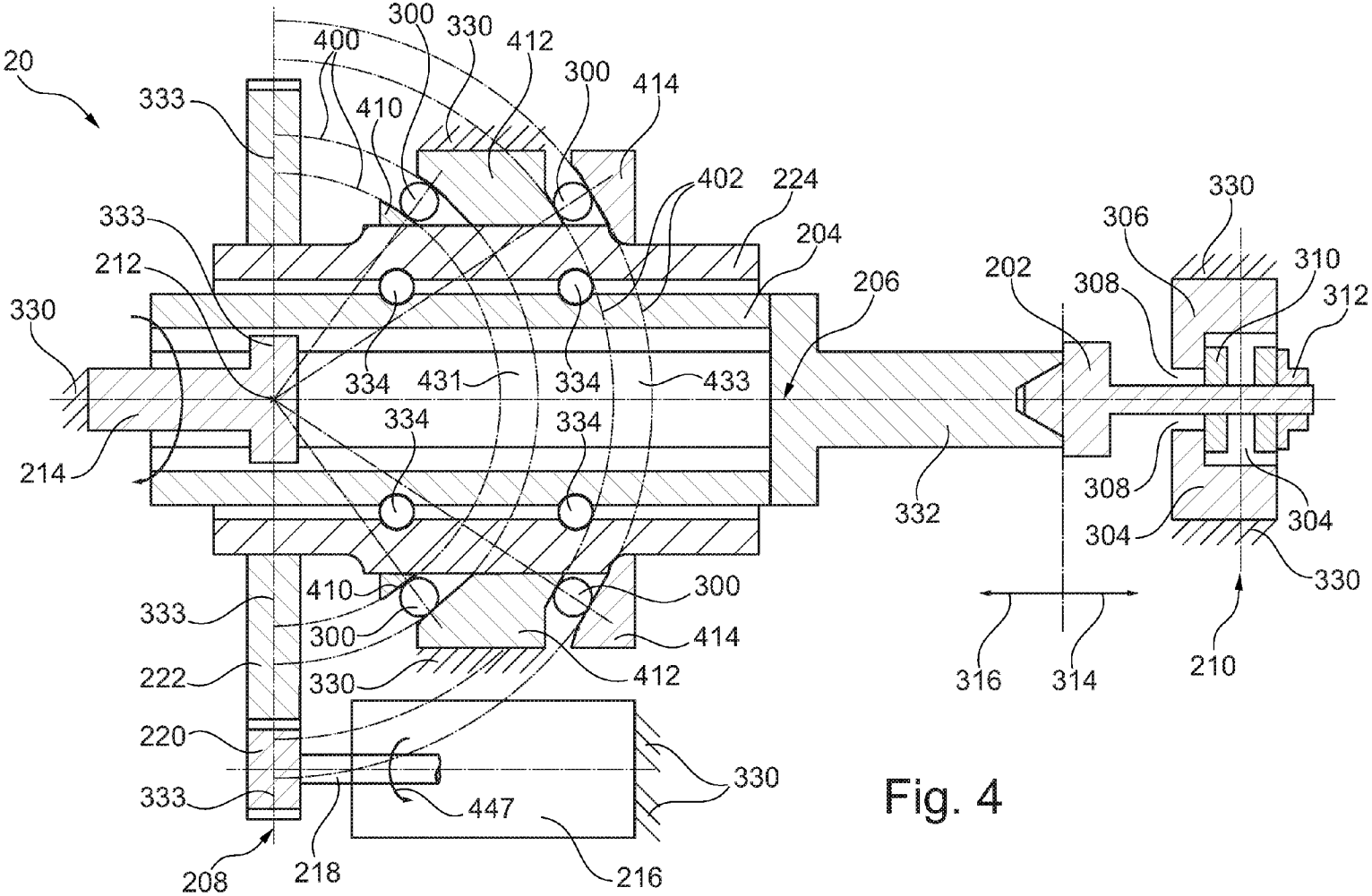
FIG. 4 illustrates a schematic view of a pump according to another exemplary embodiment of the invention.

FIG. 4 illustrates a schematic view of a pump 20 according to another exemplary embodiment of the invention. In the following, basically the differences with regard to the embodiment of FIG. 3 will be explained.

According to FIG. 4, the actuator bearing 208 is configured asymmetrically as a pair of spherical bearings each having a respective set of bearing balls 300, wherein all bearing balls 300 of a set are located on a respective surface of a respective sphere 400, 402. A first set of bearing balls 300 is configured for running along a first trajectory 431 assigned to the sphere 400. A second set of bearing balls 300 is configured for running along a second trajectory 433 assigned to the sphere 402. The spheres 400, 402 both have the pendulum point 212 as common center but have different radii. Sphere 402 has a larger radius than sphere 400. Three bearing shells 410, 412 and 414 are shown which form part of the pair of spherical bearings. The bearing shells 410, 414 are arranged at the nut 224, whereas the central bearing shell 412 is attached to the drive cabinet 330. A rotation direction of the drive shaft 218 is indicated by reference numeral 447.

The embodiment of FIG. 4 has the advantage of a compact design since the drive unit 216 can be arranged on the right-hand side of the pendulum point 212. Further on the gearing interface is located outside of the bearing arrangement 208, 210 which increases the flexibility in coupling the drive unit 216. The spatial distance between the piston bearing 210 and the actuator bearing 208 is further increased advantageously by locating the tooth wheels 220, 222 as well as the functional part of the piston actuator rotation inhibitor 214 far on the left-hand side of FIG. 4. Hence, in contrast to FIG. 3, the drive unit 216 is arranged, with regard to the direction of the common rigid axis 206, between the actuator bearing 208 and the piston bearing 210.

Figure 5:
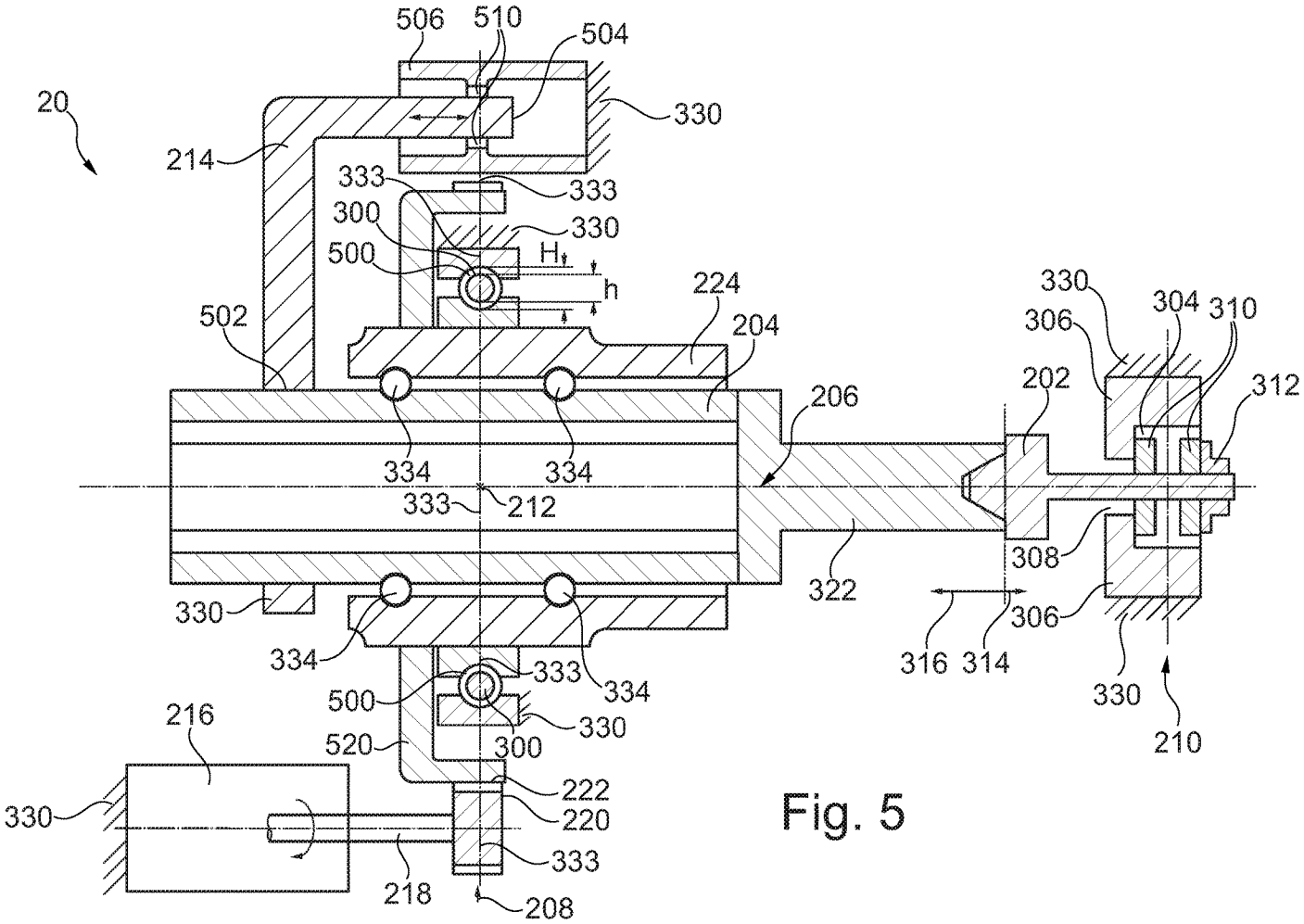
FIG. 5 illustrates a schematic view of a pump according to another exemplary embodiment of the invention.

FIG. 5 illustrates a schematic view of a pump 20 according to still another exemplary embodiment of the invention. In the following, basically the differences with regard to the embodiment of FIG. 3 will be explained.

According to FIG. 5, the piston actuator rotation inhibitor 214 (being of a cantilever type and being basically L-shaped in the cross-sectional view of FIG. 5) is arranged around and fixedly connected to (for instance welded to) the piston actuator 204. More specifically, the piston actuator rotation inhibitor 214 has a first end 502 which is fixedly connected (for instance welded) to the piston actuator 204 and comprises a free second end 504 located within a hollow body 506 (being fixed at the drive cabinet 330 and having a constriction 510) so as to define a narrow contact area close to the plane 333 including the pendulum point 212 restricting the axial rotational degree of freedom only. The second end 504 is arranged to interact with the hollow body 506 in the plane 333 including the pendulum point 212 and being perpendicular to the common rigid axis 206, i.e. in the piston actuator rotation inhibition operates very close to or even at the neutral point.

By the implementation of a cup shaped member 520 being fixedly connected to the nut 224 and carrying the nut tooth wheel 222 at an exterior surface, it can be ensured that the force transmission between the tooth wheels 220, 222 as well as the piston actuator rotation inhibition occur within actuator bearing plane 333 which is oriented perpendicular to the common rigid axis 206 and comprises the pendulum point 212. This arrangement as well as the described principles of FIG. 3 and FIG. 4 keep the piston bearing 210 in principle free of any additional driving load beside of the concentrically load due to the piston movement and the pump pressure. As can be taken from FIG. 5, the cup shaped member 520 is axially guided around the actuator bearing 208 so as to bring the nut tooth wheel 222 in functionally cooperating position within plane 333.

According to FIG. 5, the actuator bearing 208 is configured as a compact and simple groove ball bearing having a plurality of bearing balls 300 all located in a circular ring space 500, which may be denoted as a groove, around the pendulum point 212. A cross-sectional area of the circular ring space 500 is larger than a cross-sectional area of the bearing balls 300. Therefore, also a ring space diameter H is larger than a bearing ball diameter h, so that the condition $h<H$ is fulfilled. By loosely locating the bearing balls 300 in the circular ring space 500, it is possible to enable a tolerance equilibration or compensation motion of the bearing balls 300 perpendicular to their motion around the circular ring space 500.

Figure 6:
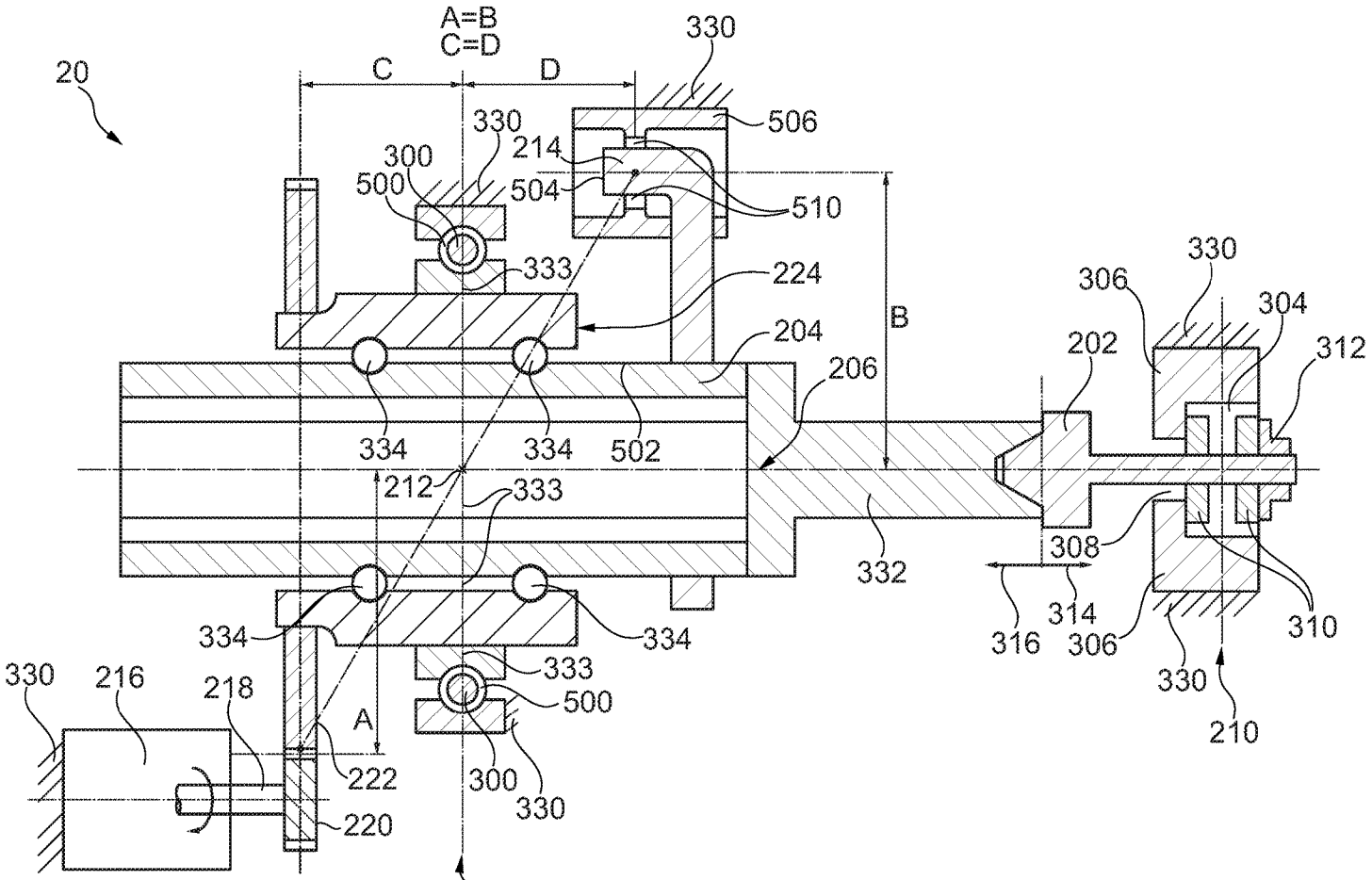
FIG. 6 illustrates a schematic view of a pump according to another exemplary embodiment of the invention.

FIG. 6 illustrates a schematic view of a pump 20 according to yet another exemplary embodiment of the invention. In the following, basically the differences with regard to the embodiment of FIG. 5 will be explained.

According to FIG. 6, the shaft tooth wheel 220 and the nut tooth wheel 222 are located so as to engage one another outside (according to FIG. 6 on the left-hand side) of plane 333 including the pendulum point 212 and being perpendicular to the common rigid axis 206. Furthermore, the second end 504 of the piston actuator rotation inhibitor 214 is arranged to interact with the hollow body 506 outside (according to FIG. 6 on the right-hand side, i.e. on an opposite side) of the plane 333. In other words, tooth wheel force transmission on the one hand and piston actuator rotation inhibition on the other hand occur on opposing sides of plane 333. However, compensation of part and/or interface tolerances and/or disturbing forces and loads is nevertheless possible also according to FIG. 6, since the shaft tooth wheel 218 and the nut tooth wheel 220 on the one hand and the second end 504 of the piston actuator rotation inhibitor 214 on the other hand are located relatively to one another so that effectively acting residual moments of the drive unit 216 (which would be needed to be compensated by the piston bearing 210) are substantially zero or at least small. This can achieved by arranging the mentioned components in accordance with a geometric condition balancing the leverages A with B and C with D and the angular condition between the contact area of the tooth wheels 220, 222 and the contact area of the piston actuator rotation inhibitor 214 with the constriction 510 of the hollow body 506. This angular condition could not be shown within the cross section of FIG. 6 since it is perpendicular to the common rigid axis 206 or parallel to the plane 333. In this condition, "A" denotes a radial distance between the common rigid axis 206 and the teeth engagement position between the tooth wheels 220, 222. "B" denotes a radial distance between the common rigid axis 206 and a radial center of the second end 504. "C" denotes an axial distance between the pendulum point 212 and the teeth engagement position between the tooth wheels 220, 222. "D" denotes an axial distance between the pendulum point 212 and the piston actuator rotation inhibition position at constriction 510. The advantage of FIG. 6 is an extremely simple and cost efficient design which nevertheless ensures a high lifetime of the components of the pump 20.

It should be noted that the term "comprising" does not exclude other elements or features and the term "a" or "an" does not exclude a plurality. Also elements described in association with different embodiments may be combined. It should also be noted that reference signs in the claims shall not be construed as limiting the scope of the claims.

The invention claimed is:

1. A pump for pumping fluid, the pump comprising:

a working chamber;

a piston assembly configured for reciprocating within the working chamber to thereby displace fluid;

a piston actuator being rigidly assembled with the piston assembly at least in a working mode of the pump to thereby transmit drive energy to the piston assembly to reciprocate along a common rigid axis of a piston-actuator-assembly provided by the piston assembly and the piston actuator; and a bearing arrangement bearing the piston assembly and the piston actuator in the pump so that the piston-actuator-assembly is capable of performing a pendulum-type compensation motion around a pendulum point at the piston actuator on the common rigid axis.

2. The pump according to claim 1, wherein the bearing arrangement comprises an actuator bearing supporting the piston actuator at the pendulum point.

3. The pump according to claim 2, wherein the actuator bearing has a configuration selected from the group consisting of:

the actuator bearing is configured for supporting the piston actuator at the pendulum point while allowing for a rotation of the piston-actuator-assembly around the pendulum point;

the actuator bearing is the only bearing which bears the piston actuator;

the actuator bearing is configured as a spherical bearing having a plurality of bearing balls all located on a surface of a sphere around the pendulum point;

the actuator bearing is configured as a pair of spherical bearings each having a respective plurality of bearing balls all located on a respective surface of a respective sphere, wherein the spheres both have the pendulum point as common center but have different radii;

the actuator bearing is configured as a groove ball bearing having a plurality of bearing balls all located in a circular ring space around the pendulum point; and the actuator bearing is configured as a groove ball bearing having a plurality of bearing balls all located in a circular ring space around the pendulum point, and a cross-sectional area of the circular ring space is larger than a cross-sectional area of the balls to thereby enable a compensation motion of the balls perpendicular to their motion around the circular ring space.

4. The pump according to claim 1, wherein the bearing arrangement comprises a piston bearing supporting the piston assembly at a piston bearing location with a volume-type positioning allowance to spatially limit the pendulum motion at the piston assembly.

5. The pump according to claim 4, wherein the piston bearing is the only bearing which bears the piston assembly.

6. The pump according to claim 4, wherein the piston bearing comprises:

a fixed hollow abutment structure delimiting the piston bearing location and having a through hole through which the piston assembly extends; and at least one bearing ring surrounding an exterior surface of the piston assembly and being located within the fixed hollow abutment structure.

7. The pump according to claim 6, wherein the at least one bearing ring is configured as one of the group consisting of a piston sealing, a pair of axially spaced bearing rings, and at least one bearing ring in addition to a piston sealing.

8. The pump according to claim 4, wherein an axial distance between the pendulum point and a center of the piston bearing is larger than an axial extension of the piston bearing location.

9. The pump according to claim 1, wherein the bearing arrangement comprises a plurality of bearings, wherein at least one of the piston assembly and the piston actuator is supported by only a single one of the plurality of bearings.

10. The pump according to claim 1, comprising a piston actuator rotation inhibitor configured for cooperating with the piston actuator so as to inhibit rotation of the piston actuator around the common rigid axis.

11. The pump according to claim 10, wherein the piston actuator rotation inhibitor has a configuration selected from the group consisting of:

the piston actuator rotation inhibitor is configured for performing a rotation inhibiting interaction with the piston actuator by taking up moments from the piston actuator in a plane including the pendulum point and being perpendicular to the common rigid axis;

at least part of the piston actuator rotation inhibitor is arranged at a position selected from a group consisting of a position in an interior of the piston actuator, and a position around the piston actuator;

the piston actuator rotation inhibitor has a first end which is fixedly connected to the piston actuator and comprises a free second end located within a hollow body so as to enable a limited compensation motion of the second end;

the piston actuator rotation inhibitor has a first end which is fixedly connected to the piston actuator and comprises a free second end located within a hollow body so as to enable a limited compensation motion of the second end, and the second end is arranged to interact with the hollow body in a plane including the pendulum point and being perpendicular to the common rigid axis.

12. The pump according to claim 1, wherein the pump comprises a drive unit for generating the drive energy for driving the piston actuator and, in turn, the piston assembly.

13. The pump according to claim 12, wherein the drive unit is configured for generating rotational drive energy at a drive shaft of the drive unit.

14. The pump according to claim 13, comprising a gear mechanism configured for converting the rotational drive energy into a linear motion of the piston actuator.

15. The pump according to claim 14, wherein the gear mechanism in cooperation with the piston actuator are configured as a ball screw comprising a mandrel as the piston actuator and a nut cooperating with the mandrel and being rotatable by the drive unit.

16. The pump according to claim 15, comprising a piston actuator rotation inhibitor member configured for cooperating with the mandrel so as to inhibit rotation of the mandrel when the nut rotates.

17. The pump according to claim 15, comprising a shaft tooth wheel mounted for rotating with the drive shaft and comprising a nut tooth wheel mounted for rotating with the nut, wherein the shaft tooth wheel and the nut tooth wheel are arranged to engage one another so as to transfer drive energy from the drive shaft via the nut to the mandrel.

18. The pump according to claim 17, comprising at least one of the following features:

the shaft tooth wheel and the nut tooth wheel are located so as to engage one another in a plane including the pendulum point and being perpendicular to the common rigid axis;

the shaft tooth wheel and the nut tooth wheel are a pair of straight toothed spur wheels;

the shaft tooth wheel and the nut tooth wheel are a pair of helical toothed spur wheels.

19. The pump according to claims claim 17, wherein the shaft tooth wheel and the nut tooth wheel are located so as to engage one another outside of a plane including the pendulum point and being perpendicular to the common rigid axis, and the second end of the piston actuator rotation inhibitor is arranged to interact with the hollow body at an opposite side of this plane, and wherein a contact area of the shaft tooth wheel and the nut tooth wheel on the one hand and a contact area of the second end on the other hand are located relatively to one another so that residual moments acting on the piston actuator are less than 20% of the moments generated by the drive unit.

20. A method of operating a pump for pumping fluid, the method comprising:

rigidly assembling a piston actuator with a piston assembly which is located at least partially within a working chamber of the pump;

moving the piston actuator to thereby transmit drive energy to the piston assembly to reciprocate along a common rigid axis of a piston-actuator-assembly provided by the piston assembly and the piston actuator to thereby displace fluid within the working chamber; and bearing the piston assembly and the piston actuator in the pump by a bearing arrangement so that the piston-actuator-assembly provided by the piston assembly and the piston actuator is capable of performing a pendulum-type compensation motion around a pendulum point at the piston actuator on the common rigid axis.

* * * * *